US005098139A

United States Patent [19]

Larsson

[11] Patent Number: 5,098,139

[45] Date of Patent: Mar. 24, 1992

[54] HIGH SECURITY LOCK AND LATCH FOR SLIDING DOORS

[76] Inventor: Leif T. Larsson, 215 West 23rd Street, North Vancouver, British Columbia, Canada, V7M 2B4

[21] Appl. No.: 526,767

[22] Filed: May 18, 1990

Related U.S. Application Data

[63] Continuation of Ser. No. 287,463, Dec. 20, 1988, abandoned.

[51] Int. Cl.[5] ..... E05C 3/10

[52] U.S. Cl. ..... 292/97; 292/337

[58] Field of Search ..... 292/DIG. 46, 97, 100, 292/123, 126, 200, 226, 108, 304, 337; 70/95, 99

[56] References Cited

U.S. PATENT DOCUMENTS

| | | | |
|---|---|---|---|
| 977,777 | 12/1910 | Branscom | 292/108 X |
| 1,192,105 | 7/1916 | Patterson | 292/100 |
| 1,686,417 | 10/1928 | Norman | 292/108 |
| 2,666,319 | 1/1954 | Price | 70/97 |
| 2,810,284 | 10/1957 | Wartian | 70/99 |
| 3,025,693 | 3/1962 | Braginetz | 292/126 X |
| 3,177,687 | 4/1965 | Tucker | 70/97 |
| 3,216,229 | 11/1965 | Moncada | 70/100 |
| 3,390,557 | 7/1968 | Erickson | 70/97 |
| 3,596,954 | 8/1971 | Hull | 292/128 |
| 3,899,201 | 8/1975 | Paioletti | 292/25 |
| 3,899,906 | 8/1975 | Bradstock | 292/200 X |
| 4,068,874 | 1/1978 | Fleming et al. | 292/DIG. 4 B X |
| 4,127,016 | 11/1978 | Ibsen | 292/200 |
| 4,378,684 | 4/1983 | Dugan et al. | 70/100 |
| 4,563,885 | 1/1986 | Madden | 70/97 |

*Primary Examiner*—Richard E. Moore

*Attorney, Agent, or Firm*—Barrigar & Oyen

[57] ABSTRACT

Prior latches for sliding doors typically lock only from the inside of the door. The present invention provides a lock and latch system which allows the sliding door to be locked using a key from inside or outside the door, allowing the home owner to prevent unauthorized access by the picking of the external lock or breaking of the glass door and releasing of the lock from the inside. This is accomplished by providing a lock and latch in which the latch hook is rotated either by an internal handle or an external key. A rotating lug member, which is rotated from the interior by a key, can be engaged to block rotation of the latch.

20 Claims, 5 Drawing Sheets

HIGH SECURITY LOCK AND LATCH FOR SLIDING DOORS

CROSS-REFERENCE TO RELATED APPLICATIONS

This is a continuation of application Ser. No. 07/287,463, filed Dec. 20, 1988, now abandoned.

BACKGROUND OF THE INVENTION

The invention relates to locks, and more particularly to high security locks for sliding doors.

In existing sliding doors, such as glass patio doors, the door is locked from the inside by a simple hook mounted in the leading edge of the door and which is pivoted by means of a handle to engage the strike plate in the door frame. It is generally not possible to lock or unlock the door from the outside and accordingly the sliding door cannot safely be used as an exit when the house is being left unattended for an extended period, nor can entry to the locked house be made by the home owner through the sliding doors. Further, the latch cannot generally be locked in place using a key. Another common drawback with existing sliding doors is that once a burglar has gained entry to the house he can exit through the sliding door without difficulty.

Various locking devices have been developed to allow sliding doors to be locked as the party exits. For example, U.S. Pat. No. 2,666,319 issued Jan. 19, 1954 to Price discloses a combined latch and lock for sliding doors which is key controlled from the outer side of the door and finger controlled from the inside of the door. One limitation of the design of this lock is that it does not provide a means for preventing from the inside the opening of the door by a key from the outside. Further, this lock is relatively easy to pick, and access can easily be gained from the outside by breaking the glass in the vicinity of the lock and reaching in to operate the inside handle.

Similarly, U.S. Pat. No. 3,177,687 issued Apr. 13, 1965 to Tucker discloses a lock and latch mechanism for sliding doors. Here the latch is operated by both a handle from the inside of the door and a cylinder lock mechanism from the outside of the door. Again, there is no way from the inside to prevent the opening of the lock by a key from the outside, nor to prevent the unauthorized rotation of the interior handle and the lock is thus less secure from unauthorized entry.

U.S. Pat. No. 3,216,229 issued Nov. 9, 1965 to Moncada discloses a door latch device which may be latched or unlatched from inside the door by means of a manually rotatable knob. The latch may be unlatched from the outside by a key operated member engaging the rotatable knob. A slidable knob is provided which prevents the latch from being unlatched from the outside. In this design the tongue assembly is mounted in the door frame. One of the limitations of this device is that it does not permit positive locking of the latch with a key from the inside. Thus, an intruder could break the glass and insert a hand or wire to open the door and gain entry.

U.S. pat. No. 3,390,557 issued July 2, 1968 to Erickson et al. discloses a latch which may be opened from the outside by a key and from the inside by a manual member. A safety latch is disposed inside and, when in the active position, prevents unlocking by the key. The latch is also designed to prevent unauthorized opening of the door from the outside by a knife blade or similar tool. Again, however, positive locking from the inside using a key is not possible, and an intruder could simply break the glass and open the latch from the interior.

U.S. Pat. No. 4,378,684 issued Apr. 5, 1983 to Dugan et al. discloses a locking mechanism for a sliding door in which exit through the door can be positively prevented. Locking cylinders on either side of the door operate directly on an arcuate latching device. However, unlatching of the door by the external key cannot be positively prevented. An intruder could gain entry by picking or breaking the exterior lock.

U.S. Pat. No. 4,563,885 issued Jan. 14, 1986 to Madden et al. discloses a lock assembly for sliding doors in which the operation of the latch from the inside or outside can be prevented by the operation of a key from the outside. Thus picking or breaking the outside lock allows access and the door cannot be locked from the inside.

All of the above prior art locks are "mortised" locks in that they require mounting within the door itself, as opposed to rim locks which are mounted on the side of the door, such as that shown in U.S. Pat. No. 3,596,954 issued Aug. 3, 1971 to Hull et al..

Thus, none of the prior art locks for sliding doors provide a lock which can be positively locked from both outside and inside the door using a key, allowing the home owner to use the sliding door as an exit door yet allowing security from unauthorized entry.

SUMMARY OF THE INVENTION

The present invention provides a lock and latch system which allows the sliding door to be locked using a key from inside or outside the door, allowing the home owner to prevent unauthorized access by the picking of the external lock or breaking of the glass door and releasing of the lock from the inside. This is accomplished by providing a lock and latch in which the latch hook is rotated either by an internal handle or an external key. A rotating lug member, which is rotated from the interior by a key, can be engaged to block rotation of the latch.

BRIEF DESCRIPTION OF THE DRAWINGS

In drawings which illustrate a preferred embodiment of the invention.

DETAILED DESCRIPTION OF A PREFERRED EMBODIMENT

Figure 1:
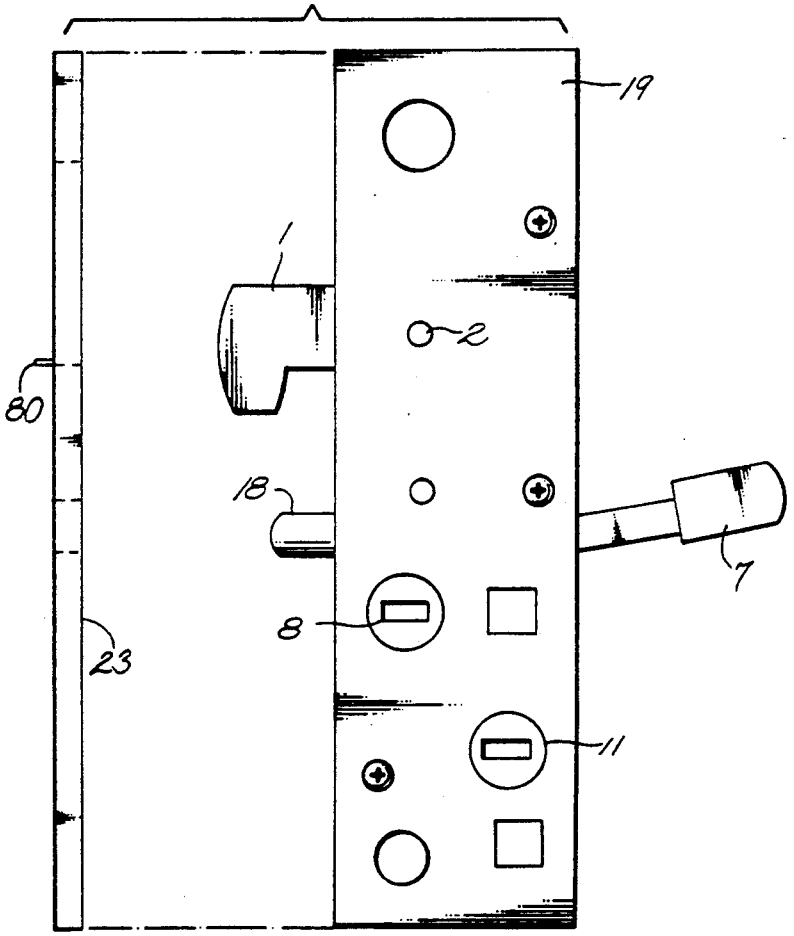
FIG. 1 is a front view of the invention lock case (not to scale) with the lock case cover and internal cylinder housing removed.
Figure 2:
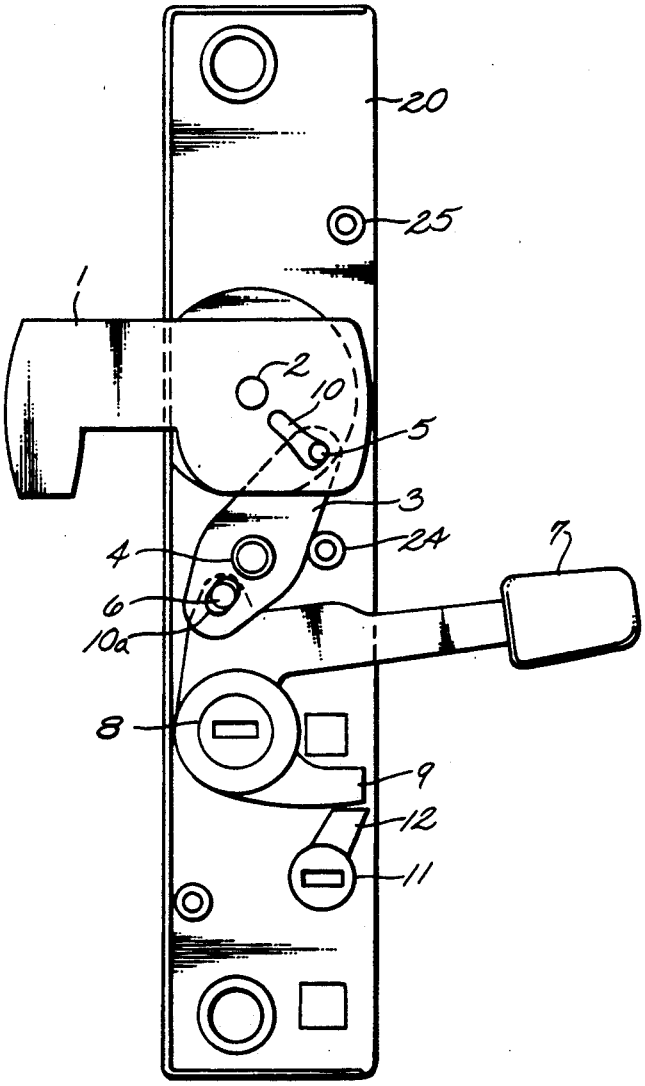
FIG. 2 is a front view of the invention lock case with the lock case side, lock case cover and internal cylinder housing removed.

As shown in FIGS. 1 and 2, the latch or hook lock 1, pivots on the latch axle 2, and thereby engages and disengages the strike plate 23. Strike plate 23 requires a catch 80 to allow adjustment of the space between hook 1 and the door frame. Strike plate 23 and hook 1 are shown out of engagement in FIG. 1, and in engagement in FIG. 7. The latch is activated by the movement of the link pin 5 within the cutout 10 of the latch 1. The limit of travel of the link 3 upon latching the latch is set by the link stop 24. The shape of the mating surfaces between the link pin 5 and the latch 1, the location of the link pin 5 on the link 3, the location of the mating surfaces between the link pin 5 and the latch 1 relative to the pivot points of the link 3 and the latch 1 and the location of the link stop 24 are such that, when the latch is lowered, latch 1 is held in the latched position by link pin 5 and attempted rotation of the latch 1 by forcing the end of the latch is prevented by link pin 5 so long as the handle 7 remains in the closed (up) position.

The movement of the link pin 5 is determined by the movement of the link 3. Link 3 rotates about the link axle 4. Lever pin 6 actuates the link 3 rotation through a mating surface of the cutout 10*a* of the link 3.

Lever pin 6 is attached to lever 9 and moves with the lever as the lever is rotated about hub 8. Hub 8 has a hole formed to accommodate the rotating shaft member 16 of the key lock. Hub 8 is mounted within the lock case base 20 and the lock case top 19, such as to permit free rotation of the lever 9 and the hub 8, within the limits of movement of the link 3.

Handle 7 is attached to lever 9 to allow manual operation of the lever 9.

Locking lug member 11 rotates within the lock case base 20 and the lock case top 19, such as to permit free rotation about the slot in the locking lug member 11. The rotation of the locking lug member 11 is limited by interference with the lock case base 20. Locking lug member 11 is rotated into position by either a key lock shaft member 16 or a block key 17 (a block key has simply a thin rectagular metal end and lacks the teeth required to engage a cylinder lock). The appendage 12 of the locking lug member 11 can be moved so as to block the rotation of the lever 9, and thereby prevent the unlatching of the latch 1, until the locking lug member 11 is rotated to release the lever 9. The slot in the locking lug member 11 is formed to accommodate the rotating member of the key lock shaft member 16. The end of block key 17 is shaped to fit the slot in locking lug member 11. The operation of the block key 17 can be replaced by that of any suitably shaped device. Block key 17 is removable.

Cylinder housing 13 is shaped to accommodate any known type of cylinder lock. The cylinder lock is fitted with a removable key 15. Thus the home owner can have the lock custom made to be operated with the existing house key.

A lock case cover 21 mounts over the lock case top 19, to cover the internal workings.

The shim or spacer 22 mounts between the sliding door 14 and the lock case base 20, if necessary, to provide for clearance of the tops of any bolts or other attachment devices which may be used. It may be replaced with a handle for operating the sliding door.

Post 18 mates with a hole in the strike plate 23, to prevent the sliding door 14 from being lifted off of its tracks when the door is locked.

Figure 3:
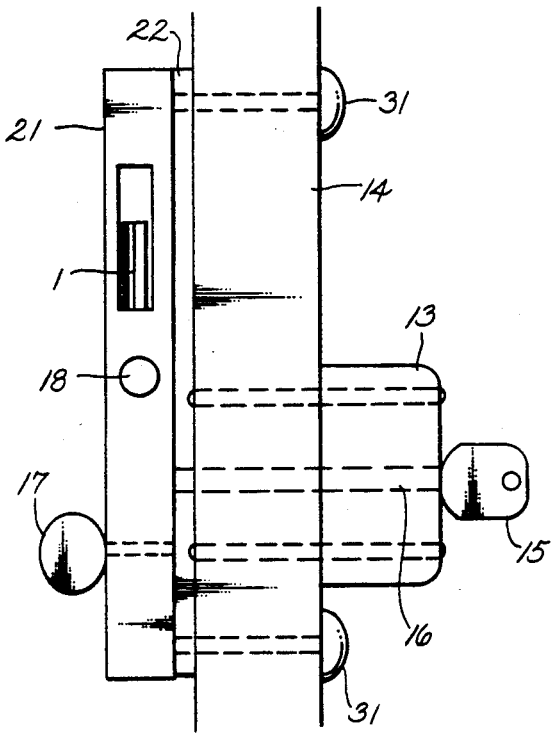
FIG. 3 is an end view of the invention showing the arrangement using the external key lock, the internal block key and the manual lever.
Figure 4:
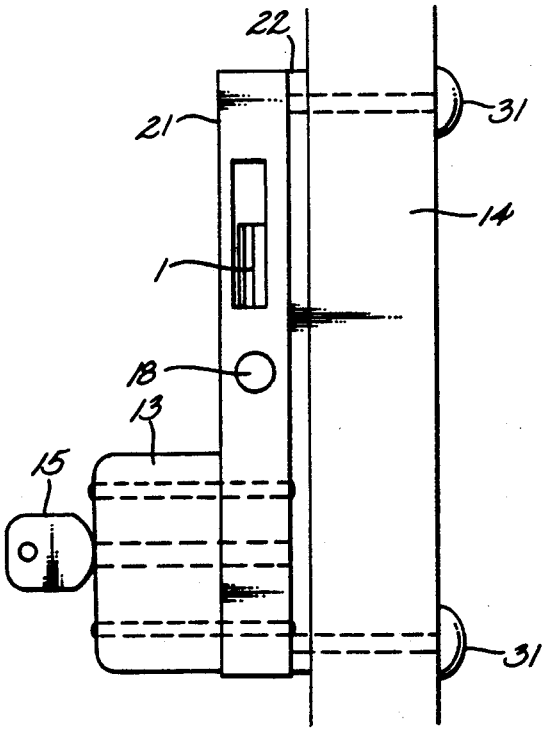
FIG. 4 is an end view of the invention showing the arrangement without the external key lock, but using the internal key lock and the manual lever.
Figure 5:
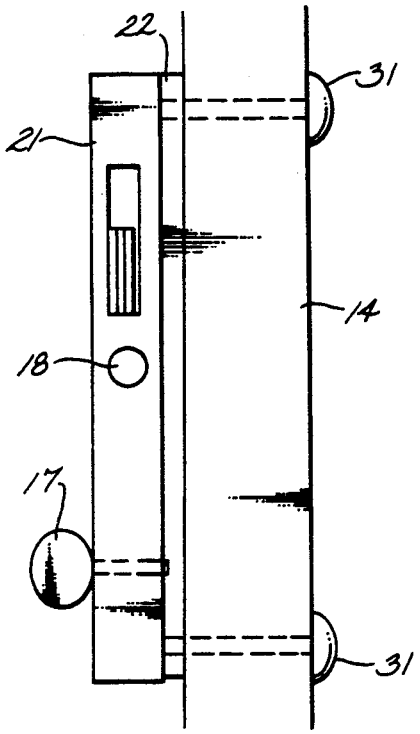
FIG. 5 is an end view of the invention showing the arrangement without the external key lock, but using the internal block key and the manual lever.
Figure 6:
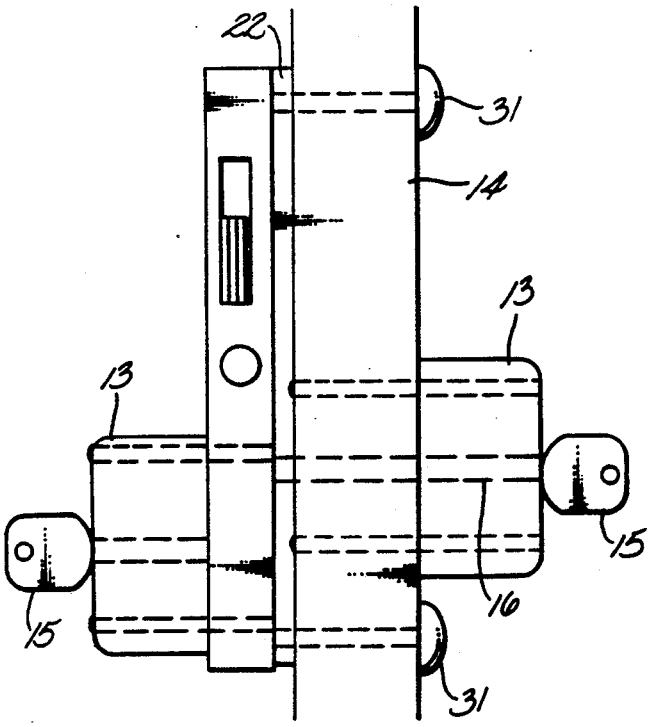
FIG. 6 is an end view of the invention showing the arrangement using the external key lock, the internal key lock and the manual lever.
Figure 7:
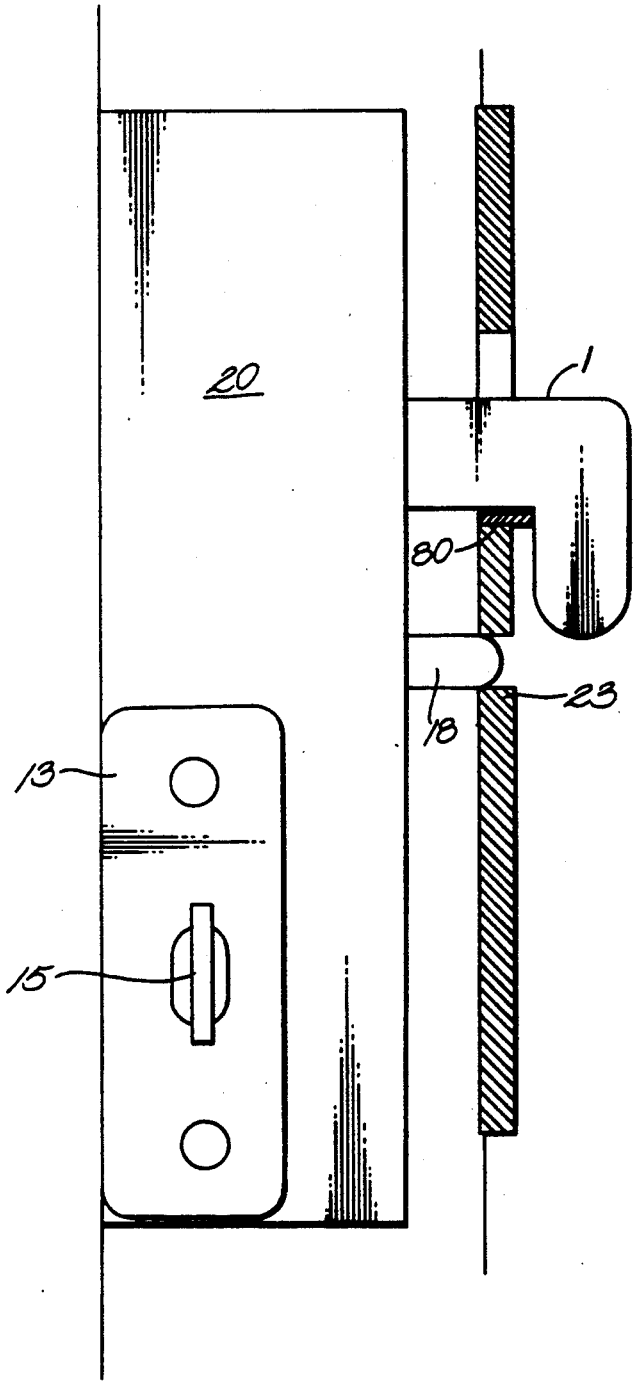
FIG. 7 is a rear (inside) view of the invention showing the arrangement using an internal key lock cylinder rather than the manual lever and showing the striker plate in cross section.

There are at least ten different arrangements for the various parts of the invention. A cylinder housing 13 may be mounted on the exterior of the sliding door 14, to enable latching and unlatching from the exterior, as shown in FIG. 3. A cylinder housing 13 may be installed on the lock case cover 21, as shown in FIG. 4, to allow the locking lug member 11 to be locked by a key from the inside. The use of the cylinder housing 13 may also be dispensed with as shown in FIG. 5, which permits the invention to be operated as a manual lever with a locking lug member 11 activated by a block key 17. Two cylinder housings 13 may also be mounted as shown in FIG. 6. This permits the latching and unlatching from the exterior as long as the locking lug member 11 is not locked from the inside. Another possibility is as shown in FIG. 7, where handle 7 is omitted, allowing the door to be opened only by operation of the key from the outside. The ability to mount the invention on either right-hand or left-hand doors, in any of the previously listed arrangement, allows for many different possible mounting arrangements.

A further arrangement is possible which would allow opening the latch by a key also from the inside. The cylinder 13 is mounted so the lock shaft 16 extends into hub 8 rather than lug member 11. The cylinder would be mounted again using screws into lock case 20.

In another embodiment, the lock may be mounted upside down relative to the lock and latch described above, in which case the need for cylinder 18 to prevent the locked door from being lifted up and freeing the latch is circumvented.

For additional security, one-way security screws 31 will be used to mount the lock case and cylinders. The outside cylinder will be fastened from the inside of the door.

As will be apparent to those skilled in the art, various modifications and adaptations of the structure above described may be made without departing from the spirit of the invention, the scope of which is to be construed in accordance with the accompanying claims.

The embodiments of the invention in which an exclusive property or privilege is claimed are defined as follows:

1. A latch assembly for securing a vertical sliding door to a striker plate of a door frame, said assembly comprising:

a) a housing adapted for attachment to the side of said sliding door and provided with an opening in one vertical edge thereof;

b) first, second and third horizontal axes mounted transversely in said housing;

c) a latch bolt pivoted on said first horizontal axis in said housing for pivotal movement through said opening in said housing and latching engagement with said striker plate, said latch bolt comprising a cut-out section;

d) handle means pivotally mounted on said second horizontal axis in said housing for rotation between an open unlatching position and a closed latching position;

e) link means pivotally mounted on said third horizontal axis for linking said handle means and said latch bolt, and comprising a cut-out section;

f) first pin mean secured to said link means for engaging said cut-out section of said latch bolt;

g) second pin means secured to said handle means for engaging said cut-out section of said link means; and h) means for selectively preventing or permitting rotation of said handle means, wherein the vertical planes of rotation of said latch, handle and link means about said first, second and third horizontal axes are located in closely adjacent vertical planes and said third horizontal axis is located in a vertical position between said first and second horizontal axes and between said first pin means and said cut-out section in said link means.

2. The assembly of claim 1 wherein said handle means is adapted to receive a rotating shaft member of a conventional key-controlled lock cylinder assembly.

3. The assembly of claim 2 further comprising a conventional key-controlled lock cylinder assembly mounted on the exterior of said door for selective rotation of said handle means.

4. The assembly of claim 1 further comprising means for engaging said striker plate to prevent relative vertical movement of said door and said striker plate.

5. The assembly of claim 1 wherein said lug member is adapted to receive the rotating shaft of a conventional key-controlled lock cylinder assembly.

6. The assembly of claim 5 further comprising at least one of a first conventional key-controlled lock cylinder assembly mounted on the interior of said door for selectively rotating said lug member and a second conventional key-controlled lock cylinder assembly mounted on the exterior of said door for selective rotation of said handle means.

7. The assembly of claim 2 further comprising a conventional key-controlled lock cylinder assembly mounted on the interior of said door for selectively rotating said handle means.

8. The assembly of claim 1 further comprising stop means secured to said housing and disposed for bearing against said link means, wherein the shape of said cut-out section of said latch bolt and the location of said first pin means on said link means are selected for causing said link means to contact said stop means and thereby prevent the rotation of said latch bolt when said handle means is in said latching position.

9. A latch assembly for securing a sliding door to a striker plate of a door frame, said assembly comprising:

a) a housing adapted for attachment to the side of said sliding door and provided with an opening in one vertical edge thereof;

b) first, second and third horizontal axes mounted transversely in said housing;

c) a latch bolt pivoted on said first horizontal axis in said housing for pivotal movement through said opening in said housing and latching engagement with said striker plate, said latch bolt comprising a cut-out section;

d) handle means pivotally mounted on said second horizontal axis in said housing for rotation between an open unlatching position and a closed latching position;

e) link means pivotally mounted on said third horizontal axis for linking said handle means and said latch bolt, and comprising a cut-out section;

f) first pin means secured to said link means for engaging said cut-out section of said latch bolt;

g) second pin means secured to said handle means for engaging said cut-out section of said link means; and h) a rotating lug member pivotally mounted in said housing and adapted to rotate between a first position engaging said handle means thereby preventing rotation of said handle means and a second position out of engagement with said handle means and permitting rotation of said handle means, wherein said handle means comprises an arm extending radially from said handle means which is positioned to come into engagement with said lug member when said lug member is in position for preventing rotation of said handle means.

10. The assembly of claim 9 wherein said handle means is adapted to receive a rotating shaft member of a conventional key-controlled lock cylinder assembly.

11. The assembly of claim 9 further comprising stop means secured to said housing and located to bear against said link means, wherein the shape of said cut-out section of said latch bolt and the location of said first pin means on said link means are selected to cause said link means to contact said stop means and thereby prevent the rotation of said latch bolt when said handle means is in said latching position.

12. The assembly of claim 10 further comprising a conventional key-controlled lock cylinder assembly mounted on the exterior of said door for selective rotation of said handle means.

13. The assembly of claim 9 further comprising means for engaging said striker plate to prevent relative vertical movement of said door and said striker plate.

14. The assembly of claim 9 wherein said lug member is adapted to receive the rotating shaft of a conventional key-controlled lock cylinder assembly.

15. The assembly of claim 14 further comprising a conventional key-controlled lock cylinder assembly mounted on the interior of said door for selectively rotating said lug member.

16. The assembly of claim 10 further comprising a conventional key-controlled lock cylinder assembly mounted on the interior of said door for selectively rotating said handle means.

17. The assembly of claim 15 further comprising a conventional key-controlled lock cylinder assembly mounted on the exterior of said door for selective rotation of said handle means.

18. The latch assembly of claim 1 wherein said means preventing rotation of said handle comprises a rotating lug member pivotally mounted in said housing and adapted to rotate between a first position engaging said handle means thereby preventing rotation of said handle means and a second position out of engagement with said handle means and permitting rotation of said handle means.

19. The assembly of claim 6 including said first and second key-controlled lock cylinder assemblies mounted in axially spaced positions.

20. The assembly of claim 1 wherein said first, second, and third horizontal axes are all located in a part of the housing which lies between said one vertical edge and an imaginary vertical plane parallel to said one vertical edge and dividing said housing in half.

* * * * *